US005369330A

United States Patent [19]

Aibara

[11] Patent Number: 5,369,330

[45] Date of Patent: Nov. 29, 1994

[54] DAMP ROD CONSTRUCTION FOR CRT GRID STRUCTURES

[75] Inventor: Nobumitsu Aibara, Tokyo, Japan

[73] Assignee: NEC Corporation, Tokyo, Japan

[21] Appl. No.: 900,347

[22] Filed: Jun. 15, 1992

[30] Foreign Application Priority Data

Jun. 13, 1991 [JP] Japan ..... 3-140509

[51] Int. Cl.[5] ..... H01J 1/18

[52] U.S. Cl. ..... 313/402; 313/269; 313/399

[58] Field of Search ..... 313/269, 399, 400, 402, 313/404, 407

[56] References Cited

U.S. PATENT DOCUMENTS

| | | | |
|---|---|---|---|
| 2,757,303 | 7/1956 | Silverman | 313/269 |
| 2,913,613 | 11/1959 | Evans | 313/269 |
| 3,638,063 | 1/1972 | Tachikawa et al. | 313/269 |
| 4,495,437 | 1/1985 | Kume et al. | 313/269 |
| 4,504,764 | 3/1985 | Sakamoto et al. | 313/269 |
| 4,780,641 | 10/1988 | Hashiba et al. | 313/407 |
| 5,172,027 | 12/1992 | Nonomura et al. | 313/269 |
| 5,227,691 | 7/1993 | Murai et al. | 313/422 |

*Primary Examiner*—Donald J. Yusko
*Assistant Examiner*—Vip Patel
*Attorney, Agent, or Firm*—Sughrue, Mion, Zinn, Macpeak & Seas

[57] ABSTRACT

A mask structure of a color picture tube includes a number of grid wires stretched over a frame in the same direction and separated from one another, and a damp wire stretched to traverse the number of grid wires in contact with the number of grid wires. The damp wire is formed of a tungsten core wire coated with a secondary emission semiconductor material layer. Thus, art asymmetrical electron lens is formed by a potential difference generated between the grid wire and the damp wire, so that an electron beam having passed through a spacing between the grid wires is deflected in a converging direction. Therefore, the electron beam is guided onto a zone of a phosphor screen shaded by the damp wire. Accordingly, a black line, which would otherwise appear because the electron beam is shielded by the damp wire, becomes inconspicuous. Namely, the display quality is elevated.

28 Claims, 1 Drawing Sheet

DAMP ROD CONSTRUCTION FOR CRT GRID STRUCTURES

BACKGROUND OF THE INVENTION

1. Field of the Invention

The present invention relates to a color picture tube, and more specifically to a color picture tube having a shadow mask structure composed of a number of grid wires, which constitute color selection or switching electrodes.

2. Description of Related Art

In a typical conventional shadow mask structure composed of a number of grid wires, which constitute color selection or switching electrodes for a color picture tube, the grid wires are stretched over a mask frame in the same direction, in parallel with one another.

In operation of the color picture tube, if the grid wires vibrate, or if the grid wires are shifted relative to one another proper color selection can no longer be obtained. In order to avoid this drawback, a damp wire is stretched over the grid wires to traverse the grid wires, and is contacted or fixed to the grid wires. With this arrangement, vibration and relative shifting of the grid wires are minimized or prevented. In ordinary cases, the damp wire is formed of a tungsten wire having a diameter of 20 μm to 30 μm.

In the above mentioned conventional mask structure, since the damp wires are formed of tungsten wire, when an electron beam passes through a spacing between each pair of adjacent grid wires, a portion of the electron beam directed toward a desired portion of a phosphor screen is blocked by the damp wire so that a corresponding portion of the phosphor screen does not emit light. In particular, in the case of a display signal for causing the whole of the phosphor screen to emit light, a black line appears in the display screen, and therefore, the display quality is inevitably deteriorated.

SUMMARY OF THE INVENTION

Accordingly, it is an object of the present invention to provide a color picture tube which has overcome the above mentioned defect of the conventional one.

Another object of the present invention is to provide a mask structure of a color picture tube capable of giving a display having a high quality in which no black line due to the damp wire occurs.

The above and other objects of the present invention are achieved in accordance with the present invention by a mask structure of a color picture tube including a frame having a pair of opposed parallel rigid supports and a pair of braces resiliently supporting the rigid supports separated from each oilier by a predetermined distance, a number of grid wires stretched between the opposed parallel rigid supports in the same direction and separated from one another, and at least one damp wire stretched between the pair of braces over and in contact with the number of grid wires in a direction traversing the stretched direction of the number of grid wires, the damp wire being formed of a conductive metal core wire coated with a semiconductor material layer.

In one embodiment the conductive metal core wire is a tungsten wire and the semiconductor material layer is formed of a secondary emission semiconductor material. The secondary emission semiconductor material is preferred to have a secondary emission ratio greater than 1. Here, the secondary emission ratio is defined to be a ratio of a second electron current to a primary electron current.

In a preferred embodiment the semiconductor material layer is formed of a material selected from the group consisting of MgO and $Cs_2O$.

The above and other objects features and advantages of the present invention will be apparent from the following description of preferred embodiments of the invention with reference to the accompanying drawings.

DESCRIPTION OF THE PREFERRED EMBODIMENTS

Figure 1:
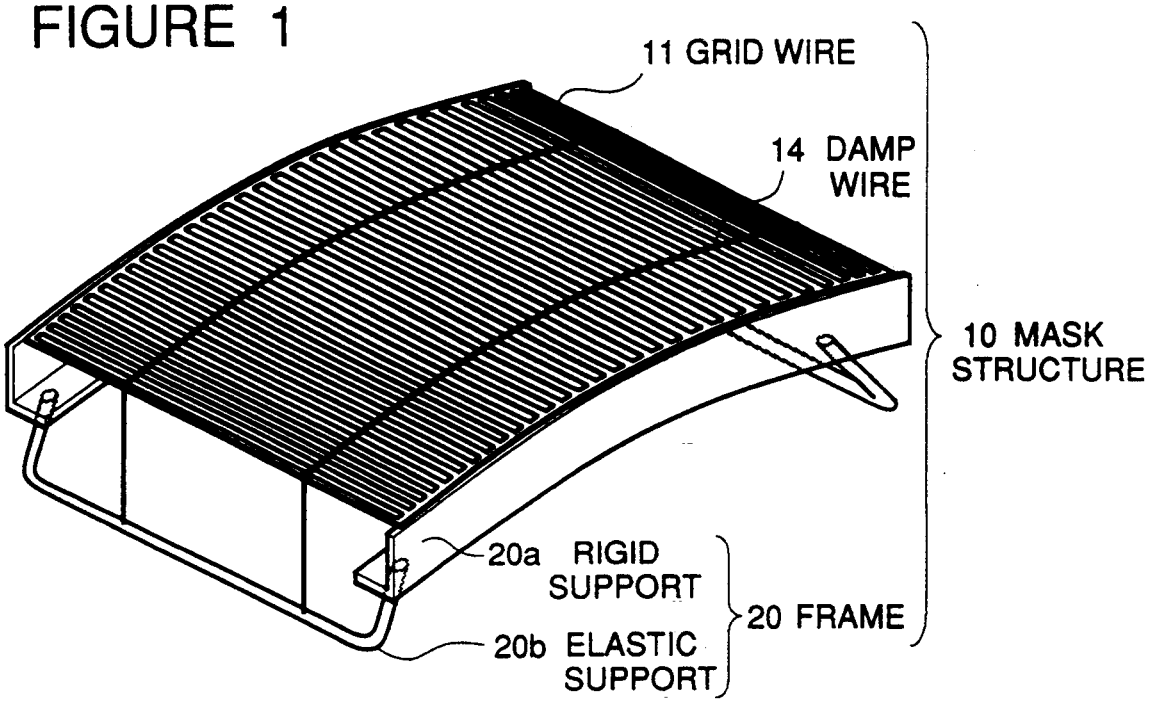
FIG. 1 is a diagrammatic perspective view of a shadow mask structure for use in a color picture tube.

Referring to FIG. 1, there is shown a diagrammatic perspective view of a shadow mask structure for use in a color picture tube, to which the present invention can be applied.

As shown in FIG. 1, a shadow mask structure 10 comprises a frame 20 including a pair of opposed parallel rigid supports 20*a* and a pair of braces 20*b* supporting opposite ends of the rigid supports 20*a*. A number of grid wires 11 are welded at their opposite ends to surfaces of the pair of rigid supports 20*a* facing a phosphor screen, so that the grid wires 11 extend transversely between the pair of opposed parallel rigid supports 20*a*. The pair of braces 20*b* are stressed in a direction substantially parallel to the directions of the grid wires 11, so that the grid wires 11 are maintained in a stretched condition between the pair of opposed parallel rigid supports 20*a*.

Figure 2:
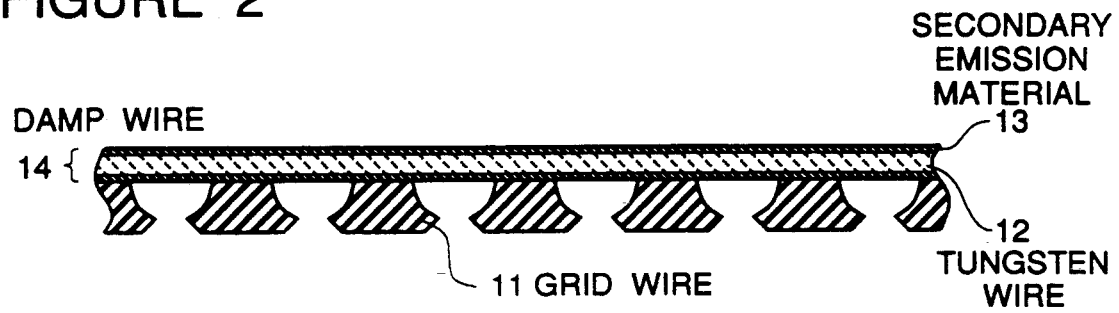
FIG. 2 is an enlarged partial view of a damp wire provided in one embodiment of the shadow mask structure in accordance with the present invention.
Figure 3:
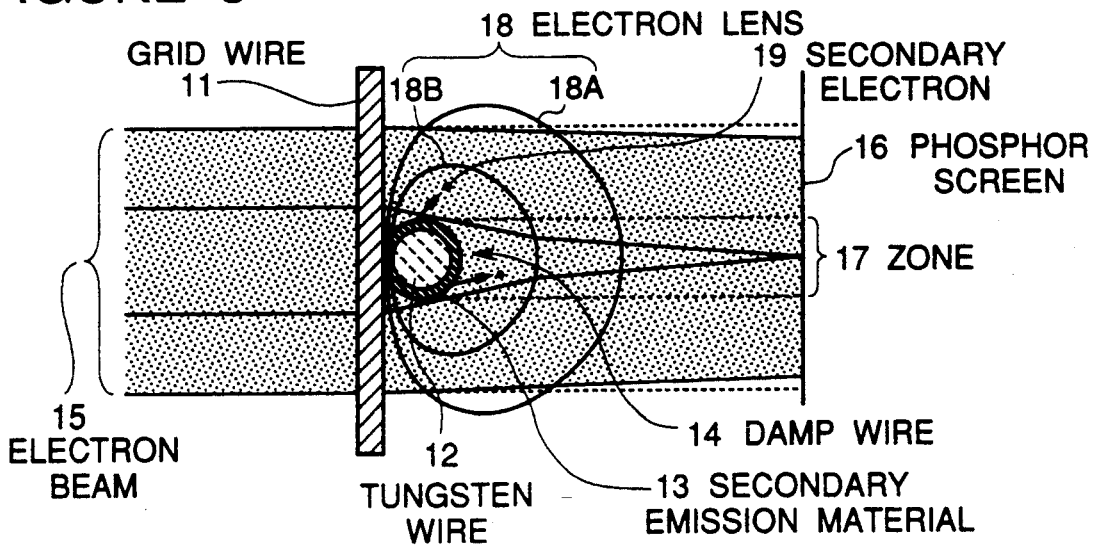
FIG. 3 is a diagrammatic view illustrating a function of the damp wire of the shadow mask structure in accordance with the present invention.

Damp wires 14 are stretched over the grid wires 11 in a direction traversing the stretched direction of the grid wires 11. The damp wires 14 are contacted or fixed to the grid wires 11, and fixed at their opposite ends to the pair of braces 20*b*, as shown in FIG. 1. In addition, the damp wire 14 is positioned at a phosphor screen side of the grid wires 11 as shown in FIG. 3. As shown in FIG. 2, the damp wire 14 is formed of a tungsten core wire 12 coated with a layer 13 of a second emission semiconductor material typified by MgO or $Cs_2O$.

A function of the damp wire 14 will be described with reference to FIG. 3. An electron beam 15 emitted from an electron gun (not shown) in order to cause a phosphor screen 16 to emit light, is firstly selected by the number of grid wires 11 functioning as the color selection electrode, so that an electron beam intended to strike a phosphor of a predetermined position is allowed through a spacing between the grid wires 11. Most of the electron beam having passed through the spacing between the grid wires 11, strikes the phosphor screen 16. However, a portion of the electron beam, having passed through the spacing between the grid wires 11, strikes the damp wire 14. A zone 17 of the phosphor screen 16 behind the damp wire 14 is shielded from the electron beam 15.

However, since the damp wire 14 has the coating layer 13 of the semiconductor material, a potential difference is induced between the grid wire 11 and the core 12 of the damp wire so that an asymmetrical electron lens 18 is formed. In FIG. 3, Reference Numerals 18A and 18B show equipotential lines forming the electron lens 18. As seen from the equipotential lines of the electron lens 18, the electron lens 18 is asymmetric relative to a plane passing through the damp wire 14 substantially in parallel to the grid wire 11, but asymmetric relative a plane passing through the damp wire 14 substantially perpendicular to the grid wires 11. By the action of the electron lens thus formed, the electron beam 15 is converged, so that the electron beam strikes the zone 17 of the phosphor screen 16 shaded from the electron beam 15 by the damp wire 14.

In addition secondary electrons 19 are emitted from an area of the secondary emission material layer 13 struck by the electron beam 15. The quantity of secondary electrons 19 is a few times the quantity of incident electrons. The secondary electrons 19 thus generated are subjected to the action of the asymmetrical electron lens 18, so that a portion of the secondary electrons 19 reaches the zone 17 of the phosphor screen 16 shaded from the electron beam 15 by the damp wire 14.

Since the damp wire 14 is stretched at the phosphor screen side of the grid wires 11, the secondary electrons 19 are generated by only the electron beam 15 which has passed through the spacing between the grid wires 11. No spurious electron is emitted in a time other than when the electron beam 15 passes through the spacing between the grid wires 11.

The secondary emission material layer 13 can be coated on the tungsten core wire 12 by various methods, for example, electrodeposition utilizing electrophoresis, a spray method spraying a mixed liquid of the secondary emission material and a high volatile solvent, a sintering method, evaporation under an inert gas of a few paseals of pressure, and a sputtering method.

In view of the effect of the electron lens, the material of the coating layer 13 for the damp wire 14 is not limited to secondary emission semiconductor material and can be of semiconductor material having no secondary emission property. However, secondary emission semiconductor material is more preferable.

As seen from the above, since the damp wire is formed of the tungsten wire coated with the semiconductor material layer, the asymmetrical electron lens is formed by a potential difference generated between the grid wire and the damp wire, and the electron beam having passed through the spacing between the grid wires is deflected in a converging direction. Therefore, the electron beam is guided onto the zone of the phosphor screen shaded by the damp wire. Accordingly, when the whole of the phosphor screen is to emit light, any black line, which would otherwise appear because the electron beam is shielded by the damp wire, will be inconspicuous. Thus, the display quality is elevated.

In addition, the electron lens formed as mentioned above is asymmetrical, and the damp wire is relatively positioned within a converging region of the electron lens. In the case of the damp wire coated with secondary emission material layer, a portion of emitted secondary electrons is deflected by the converging action of the electron lens so as to be guided to the zone of the phosphor screen shaded by the damp wire. Accordingly, probability density of electrons directed to the zone of the phosphor screen shaded by the damp wire is increased, so that the black line will become further inconspicuous.

The invention has thus been shown and described with reference to the specific embodiments. However, it should be noted that the present invention is in no way limited to the details of the illustrated structures, but changes and modifications may be made within the scope of the appended claims.

I claim:

1. A mask structure for a color picture tube including a phosphor screen, the mask structure comprising:

a frame, a number of grid wires stretched over the frame, the grid wires parallel to and separated from one another, and at least one damp wire stretched over and in contact with the grid wires, and traversing the grid wires on the side of the grid wires toward the phosphor screen, the damp wire being formed of a conductive metal core wire coated with a semiconductor material layer.

2. A mask structure as claimed in claim 1 wherein said semiconductor material layer is formed of a secondary emission semiconductor material.

3. A mask structure as claimed in claim 2 wherein said secondary emission semiconductor material has a secondary emission ratio greater than 1.

4. A mask structure as claimed in claim 3, wherein said conductive metal core wire is a tungsten wire.

5. A mask structure as claimed in claim 3, wherein said semiconductor material layer is formed of a material selected from the group consisting of MgO and $Cs_2O$.

6. A mask structure as claimed in claim 3, wherein said semiconductor material layer is formed of $Cs_2O$.

7. A mask structure as claimed in claim 2, wherein said conductive metal core wire is a tungsten wire.

8. A mask structure as claimed in claim 2, wherein said semiconductor material layer is formed of a material selected from the group consisting of MgO and $Cs_2O$.

9. A mask structure as claimed in claim 2, wherein said semiconductor material layer is formed of $Cs_2O$.

10. A mask structure as claimed in claim 1, wherein said conductive metal core wire is a tungsten wire.

11. A mask structure as claimed in claim 1, wherein said semiconductor material layer is formed of a material selected from the group consisting of MgO and $Cs_2O$.

12. A mask structure as claimed in claim 1, wherein said semiconductor material layer is formed of $Cs_2O$.

13. A mask structure as claimed in claim 1, comprising means for inducing a potential difference between each of the grid wires and the tungsten core wire of the damp wire, so as to form an asymmetrical converging electron lens at the phosphor screen side of the grid wires, so that a black line, which would otherwise be formed on said phosphor screen because an electron beam emitted toward said phosphor screen is physically blocked by the damp wire, is substantially eliminated.

14. A mask structure for a color picture tube including a phosphor screen, the mask structure comprising:

a frame comprising a pair of opposed parallel rigid supports and a pair of braces resiliently supporting the rigid supports and separating the rigid supports from each other by a predetermined distance, a number of grid wires stretched between the opposed parallel rigid supports, the grid wires parallel to and separated from one another, and at least one damp wire stretched between the pair of braces, over and in contact with the grid wires, and traversing the grid wires on the side of the grid wires toward the phosphor screen, the damp wire being formed of a conductive metal core wire coated with a semiconductor material layer.

15. A mask structure as claimed in claim 14 wherein said semiconductor material layer is formed of a secondary emission semiconductor material.

16. A mask structure as claimed in claim 15 wherein said secondary emission semiconductor material has a secondary emission ratio greater than 1.

17. A mask structure as claimed in claim 16, wherein said conductive metal core wire is a tungsten wire.

18. A mask structure as claimed in claim 16, wherein said semiconductor material layer is formed of a material selected from the group consisting of MgO and $Cs_2O$.

19. A mask structure as claimed in claim 16, wherein said semiconductor material layer is formed of $Cs_2O$.

20. A mask structure as claimed in claim 15, wherein said conductive metal core wire is a tungsten wire.

21. A mask structure as claimed in claim 15, wherein said semiconductor material layer is formed of a material selected from the group consisting of MgO and $Cs_2O$.

22. A mask structure as claimed in claim 15, wherein said semiconductor material layer is formed of $Cs_2O$.

23. A mask structure as claimed in claim 14, wherein said conductive metal core wire is a tungsten wire.

24. A mask structure as claimed in claim 14, wherein said semiconductor material layer is formed of a material selected from the group consisting of MgO and $Cs_2O$.

25. A mask structure as claimed in claim 14, wherein said semiconductor material layer is formed of $Cs_2O$.

26. A mask structure as claimed in claim 14, comprising means for inducing a potential difference between each of the grid wires and the tungsten core wire of the damp wire, so as to form an asymmetrical converging electron lens at the phosphor screen side of the grid wires, so that a black line, which would otherwise be formed on said phosphor screen because an electron beam emitted toward said phosphor screen is physically blocked by the damp wire, is substantially eliminated.

27. A shadow mask structure of a color picture tube including a frame having a pair of opposed parallel rigid supports and a pair of braces resiliently supporting the rigid supports separated from each other by a predetermined distance, a number of grid wires stretched between the opposed parallel rigid supports in the same direction and separated from one another, and at least one damp wire stretched between the pair of braces over and in contact with the number of grid wires in a direction traversing the stretched direction of the number of grid wires, the damp wire being formed of a tungsten core wire coated with a secondary emission semiconductor material layer that has a secondary emission ratio greater than 1, the damp wire being located only at a phosphor screen side of the grid wires so that:

a potential difference is induced between each of the grid wires and the tungsten core wire of the damp wire, so as to form an asymmetrical converging electron lens at the phosphor screen side of the grid wires, and the secondary emission semiconductor material layer of the damp wire is hit by only an electron beam which has passed through a spacing between each pair of adjacent grid wires so that the secondary electrons are emitted from the secondary emission semiconductor material layer of the damp wire toward a phosphor screen and no spurious electron is emitted in a time other than when the electron beam passes through the spacing between each pair of adjacent grid wires, whereby a black line, which would otherwise be formed because an electron beam emitted toward the phosphor screen is blocked by the damp wire, is prevented from appearing in the phosphor screen.

28. A shadow mask structure of a color picture tube including a frame having a pair of opposed parallel rigid supports and a pair of braces resiliently supporting the rigid supports separated from each other by a predetermined distance, a number of grid wires stretched between the opposed parallel rigid supports in the same direction and separated from one another, and at least one damp wire stretched between the pair of braces over and in contact with the number of grid wires in a direction traversing the stretched direction of the number of grid wires, the damp wire being formed of a tungsten core wire coated with a $Cs_2O$ layer having a secondary electron emission property, the damp wire being located only at a phosphor screen side of the grid wires so that a potential difference is induced between each of the grid wires and the tungsten core wire of the damp wire, so as to form an asymmetrical converging electron lens at the phosphor screen side of the grid wires, and the $Cs_2O$ layer of the damp wire is hit by only an electron beam which has passed through a spacing between each pair of adjacent grid wires so that the secondary electrons are emitted from the $Cs_2O$ layer of the damp wire toward a phosphor screen and no spurious electron is emitted in a time other than when the electron beam passes through the spacing between each pair of adjacent grid wires, whereby a black line, which would otherwise be formed because an electron beam emitted toward the phosphor screen is blocked by the damp wire, is prevented from appearing in the phosphor screen.

* * * * *

UNITED STATES PATENT AND TRADEMARK OFFICE

CERTIFICATE OF CORRECTION

PATENT NO. : 5,369,330

DATED : November 29, 1994

INVENTOR(S) : Nobumitsu Aibara

It is certified that error appears in the above-indentified patent and that said Letters Patent is hereby corrected as shown below:

Column 1, line 54, delete "oilier" and insert --other--.

Signed and Sealed this

Fourth Day of April, 1995

*Attest:*

*Attesting Officer*

BRUCE LEHMAN

*Commissioner of Patents and Trademarks*